US008179054B1

(12) United States Patent
Huang et al.

(10) Patent No.: US 8,179,054 B1
(45) Date of Patent: May 15, 2012

(54) LED POWER SUPPLY

(76) Inventors: Zhen Qiu Huang, City of Industry, CA (US); Guan Xiong Huang, City of Industry, CA (US)

( * ) Notice: Subject to any disclaimer, the term of this patent is extended or adjusted under 35 U.S.C. 154(b) by 327 days.

(21) Appl. No.: 12/386,768

(22) Filed: Apr. 24, 2009

(51) Int. Cl.
*H05B 37/00* (2006.01)

(52) U.S. Cl. ..... 315/224; 315/291; 315/307

(58) Field of Classification Search ..... 315/209 R, 315/224, 291, 307, 308
See application file for complete search history.

(56) References Cited

U.S. PATENT DOCUMENTS

2009/0273290 A1* 11/2009 Ziegenfuss ..... 315/193
2010/0244726 A1* 9/2010 Melanson ..... 315/291

* cited by examiner

*Primary Examiner* — David Hung Vu
(74) *Attorney, Agent, or Firm* — Albert O. Cota

(57) ABSTRACT

An LED power supply (LPS) (10) that is designed to replace conventional fluorescent lamps, which also include Compact Fluorescent Lamps (CFLs). The LPS (10) is comprised of three major elements: a power input circuit (PIC) (12), an LED Power Control Circuit (LPCC) (14) and an LED load 16. The PIC (12) can consist of either a d-c voltage source (12A) or an a-c voltage source (12B). The a-c voltage source (12B) is rectified and filtered to produce a filtered d-c voltage output (11') prior to being applied to an OR gate (12D) from where a filtered d-c voltage (21) is produced and applied to the LPCC (14) for further processing. The CPCC (14) functions to automatically monitor and adjust both the voltage and the current that is applied to a plurality of LEDS 71 that comprise the LED load 16. The LED load is typically configured in a series-parallel configuration.

15 Claims, 3 Drawing Sheets

LED POWER SUPPLY

TECHNICAL FIELD

The invention generally pertains to the field of d-c power supplies, and more particularly to an LED power supply that powers an LED load which is designed to replace a conventional fluorescent lamp.

BACKGROUND ART

With the rising cost of energy and a concern for the environment, a means of providing efficient, low-cost lighting has become of major importance. Currently, the prior art utilizes incandescent light bulbs and fluorescent lamps.

A typical 60 watt incandescent lamp produces a light output of approximately 750 lumens, has a useful life of approximately 1000 hours and consumes approximately 60 watts of power. Fluorescent lamps, which also include Compact Fluorescent Lamps (CFLs), are highly efficient and produce a light output of approximately 900 lumens, have a useful life of approximately 10,000 hours and consume approximately 13 watts of power. The problem with fluorescent lamps and CFLs is that they are not environmentally friendly as a result of containing highly toxic mercury, which necessitates that the lamps be properly disposed.

With the development of Light Emitting Diode (LEDs), which produce "White Light" another step forward was taken. An LED is similar to a conventional PN junction diode with one advantage, the LED produces a light at the PN junction, and LEDs are much more efficient than either an incandescent lamp or a fluorescent lamp. LEDs can be operated with a voltage that ranges from 1.5 to 4.5 volts d-c, require current in milliamps and have a useful life of up to 50,000 hours. Additionally, LEDs do not typically have catastrophic failures like incandescent and fluorescent lamps. Their light output does however diminish over time. The main concern for the proper operation of LED's is not the voltage but the current that is supplied to the LEDs. A higher current produces more light output but reduces the useful life expectancy of the LEDs. Another concern is that the voltage drop across the PN junction can vary greatly even from the same batch of LEDs thereby causing them to produce more or less light output from lamp to lamp. If using LED's in clusters, they should be "matched" so that all the LEDs light with the same intensity.

The problems associated with incandescent and fluorescent lamps are solved or at least minimized by the inventive LPS.

A search of the prior art did not disclose literature or patents that read directly on the claims of the instant invention.

DISCLOSURE OF THE INVENTION

The LED power supply (LPS) is designed to replace conventional fluorescent lamps which include Compact Fluorescent Lamps (CFLs). In its basic design, the LPS is comprised of:

A. A power input circuit (PIC) having means for producing a d-c voltage,

B. An LED load,

C. An LED power control circuit (LPCC) having:

1. Means for receiving the d-c voltage applied from the PIC,

2. Means for automatically monitoring and adjusting the voltage and the current of the applied d-c voltage commensurate with the LED load, and
3. Circuit means for applying the adjusted voltage and current to the LED load which is designed to replace a conventional fluorescent lamp.

The PIC is designed to operate from either a d-c voltage source that can range from 8 to 250 volts d-c or an a-c voltage source that typically consists of 120 volts at 60 Hertz. The a-c voltage is rectified and filtered to produce a d-c voltage which is then applied to the LPCC for further processing. The LED load is comprised of a set of LEDs that are typically connected in a series-parallel combination.

In view of the above disclosure, the primary object of the invention is to produce an LPS that:

A. Operates with an input voltage that can range from 8 to 250 volts d-c, and

B. Automatically monitors and adjusts the voltage and current that is applied to a particular configuration of LEDs that comprise the LED load.

In addition to the primary object of the invention, it is also an object of the invention to produce an LPS that:

Can be used with an LED load that is configured in various series-parallel combinations.

Can be designed to function with elongated-tube fluorescent lamps and compact fluorescent lamps (CFLs).

Produces "green" power.

Is easily and safely disposed.

Can be packaged in an Application Specific Integrated Circuit (ASIC). and

Is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment for an LED power supply (LPS) 10. The LPS 10 is designed to power a plurality of LEDs 71 which are used to replace conventional fluorescent lamps. The preferred embodiment of the LPS 10, as shown in FIGS. 1A, 1B and 2, is comprised of three major elements: a power input circuit (PIC) 12, an LED power control circuit (LPCC) 14 and an LED load 16.

Figure 1A:
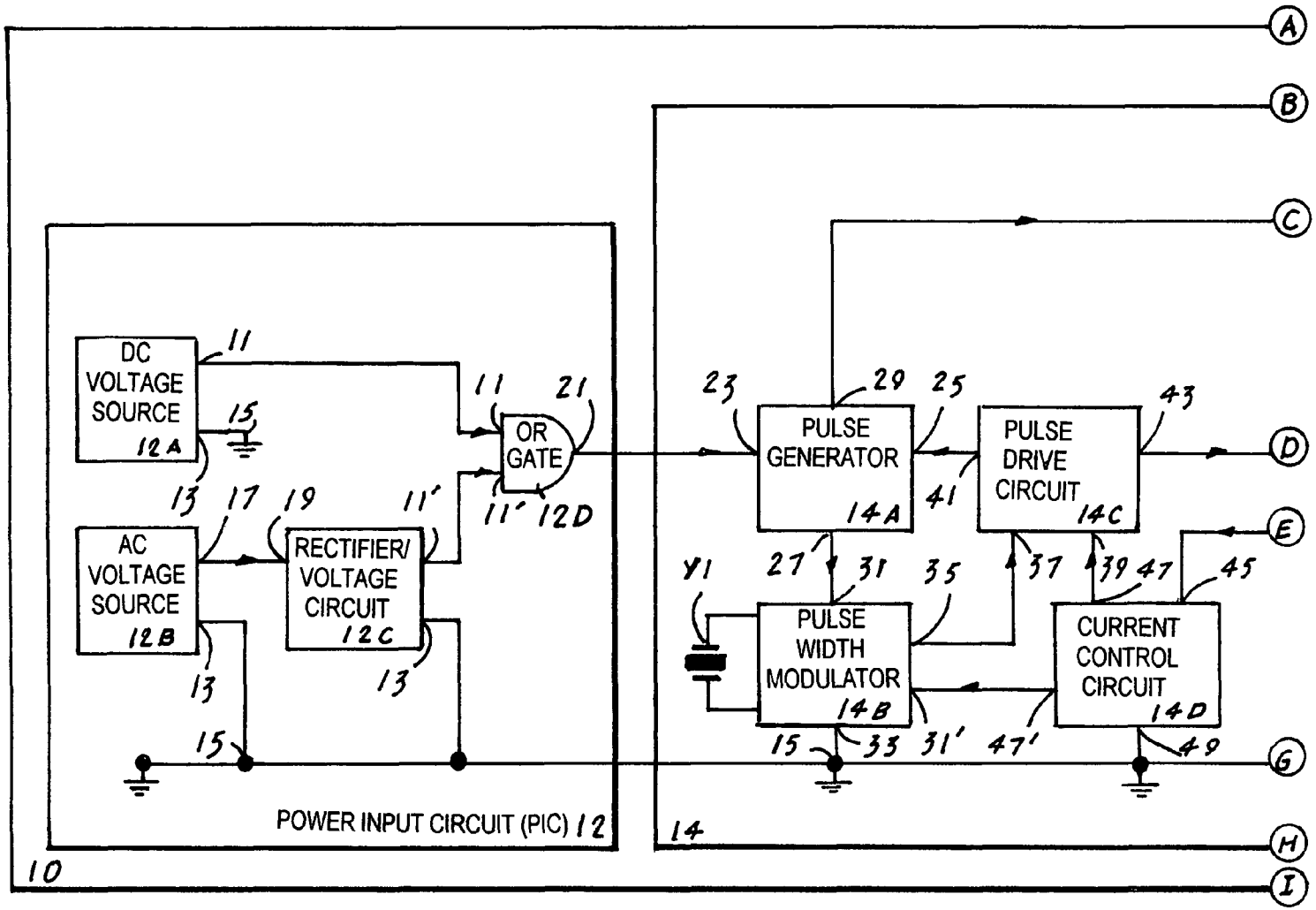
FIGS. 1A and 1B together comprise a combination block and schematic diagram showing the elements that comprise the LED power supply (LPS).
Figure 1B:
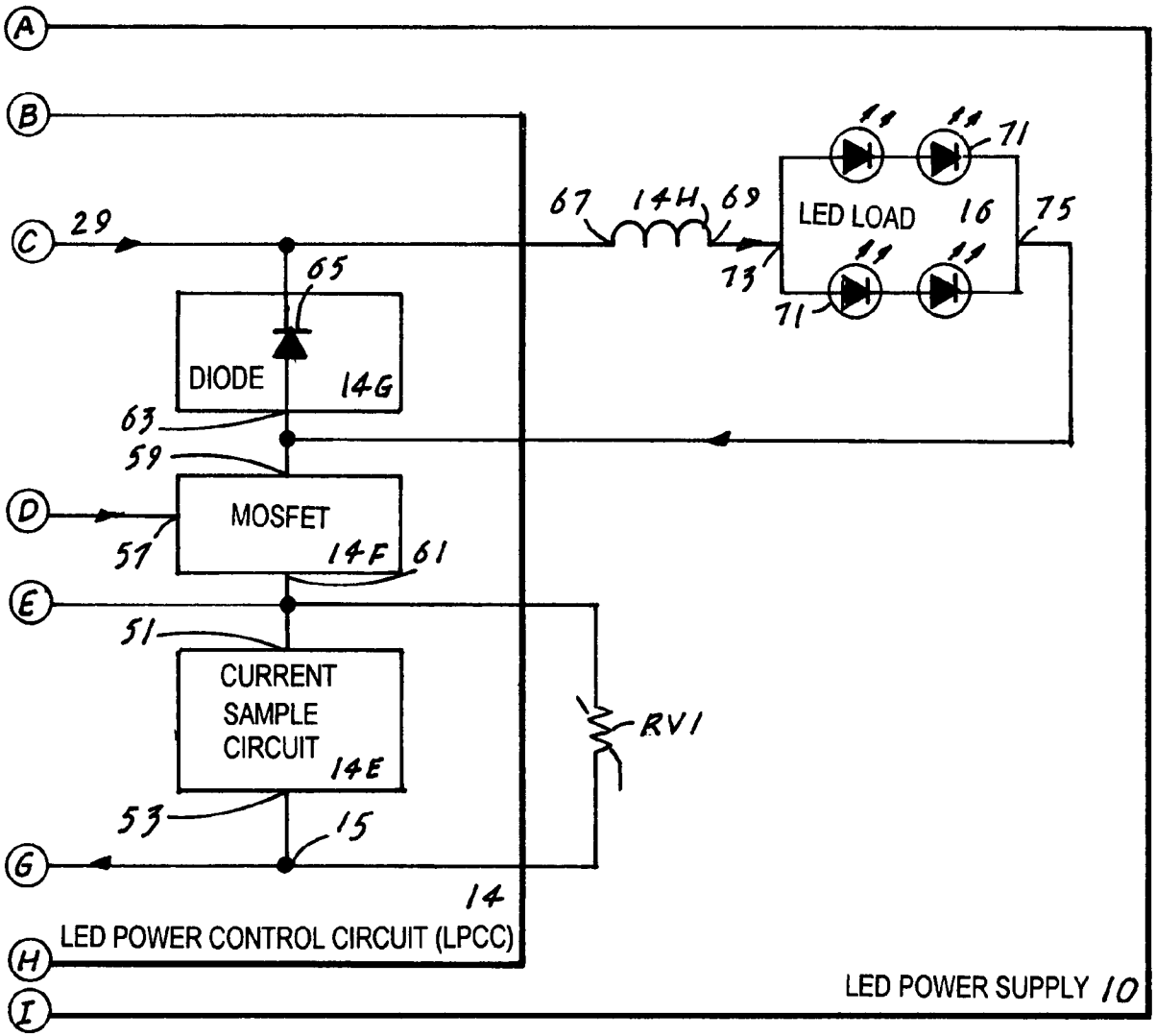
Figure 2:
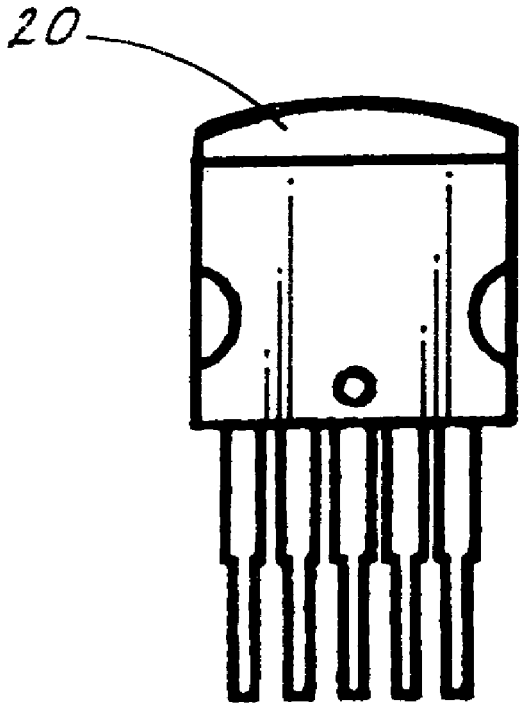
FIG. 2 is an elevational front view of an Application Specific Integrated Circuit (ASIC) that is dimensioned to include at least an LED power control circuit (LPCC) which comprises a circuit of the LPS.

The PIC 12, as shown in FIGS. 1A and 1B, is comprised of a d-c voltage source 12A, an a-c voltage source 12B, a rectifier and filter circuit 12C and an OR gate 12D.

The d-c voltage source 12A has a first d-c voltage output 11 and a second output 13 that is connected to circuit ground 15. The first d-c voltage output 11 can range between 8 to 250 volts d-c.

The a-c voltage source 12B has a first a-c voltage output 17 and a second output 13 that is connected to circuit ground 15. The a-c voltage output 17 typically consists of a utility power source that, in the United States of America, consists of 120 volts a-c at 60 Hertz.

The voltage rectifier and filter circuit 12C, which functions in combination with the a-c voltage source 12B, is comprised of a diode and a filter capacitor (not shown). The circuit 12C functions to convert the a-c voltage output 17 that is applied to an a-c voltage input 19 located on the circuit 12C that produces a filtered d-c voltage output 11' in a manner that is well known in the prior art. The circuit 12C also has a second output 13 that is connected to circuit ground 15.

The OR gate 12D, which is the final element comprising the PIC 12, allows the LPS 10 to operate with either the d-c voltage source 12A or the a-c voltage source 12B. The OR gate 12D is enabled when applied either the first d-c voltage output 11 from the d-c voltage source 12A or the filtered d-c voltage output 11' from the rectifier and filter circuit 12C. The output from the enabled OR gate 12D is a filtered d-c voltage 21 that is applied to the LPCC 14 for further processing. In lieu of the OR gate 12D, the LPS 10 can be designed to operate with an independent d-c power source 12A, or an independent a-c voltage source 12B that includes the rectifier and filter circuit 12C.

The second element that comprises the LPS 10 is the LED power control circuit LPCC 14, as also shown in FIGS. 1A and 1B. The circuit 14 is comprised of a pulse generator 14A, a pulse width modulator 14B, a pulse drive circuit 14C, a current control circuit 14D, a current sample circuit 14E, a metal-oxide semiconductor field-effect transistor (MOSFET) 14F, and a diode 14G.

The pulse generator 14A is applied a first d-c voltage input 23 that is connected to the filtered d-c voltage 21 applied from the OR gate 12D, a second input 25, a first output 27 and a second output 29. The pulse generator 14A is comprised of an oscillator having means for producing the first output 27 and the second output 29 which are each comprised of a symmetrical square wave. The first output 27 is applied to an input 31 on the pulse width modulator 14B, and the second output 29 is applied via an external coil 14H to the LEDs 71 that comprise the LED load 16.

The pulse width modulator 14B in addition to the first input 31, has a second input 31', a first output 33 that is connected to circuit ground 15, and a second output 35. The modulator 14B has means for varying the "on time" pulse width of the symmetrical square wave that is applied from the first output 27 located on the pulse generator 14A. The second output 29 from the pulse generator 14A controls the voltage and current levels that are applied to the LEDs 71 that comprise the LED load 16. The longer the "on time" of the pulse width, the higher the voltage and current that is applied to the LED load 16. To allow the modulator 14B to maintain an optimum frequency, a crystal Y1 is connected to the modulator 14B. The crystal Y1 is preferably designed to produce a frequency of 2 MHz.

The pulse drive circuit 14C includes a first input 37, a second input 39, a first output 41 and a second output 43. The circuit 14C has means for sampling the symmetrical square wave that is applied to the first input 37 from the second output 35 applied from the pulse width modulator 14B. The first output 41 is a feedback signal that is applied to the second input 25 on the pulse generator 14A. The second input 39 is applied from the first output 47 connected to the current control circuit 14D.

The pulse drive circuit 14C functions as a self-adjusting "closed loop" circuit that monitors and maintains the voltage and current that is applied to the LEDs 71 at a constant level commensurate with the configuration of the LED load 16. The second output 43 which that is comprised of a varying square wave, is applied to a first input 57 which is the gate of the MOSFET 14F.

The MOSFET 14F functions as an ON and OFF switch and includes the first input 57, a second input 59 and an output 61. When the MOSFET 14F is turned ON, current flows through the LEDs 71 to ground 15 via the current sample circuit 14E. The switching action of the MOSFET 14F allows current to flow through the LEDs 71 to ground 15 through an input 51 and a first output 53 both located on the current sample circuit 14E. The output 53 is connected directly to circuit ground 15. The current sample circuit 14E is designed to sample the current drawn by the LED load 16 and to apply the sample current to an input 45 located on the current control circuit 14D which also has a first output 47, and a second output 49 that is connected to circuit ground 15.

The current control circuit 14D produces at the first output 47, a feedback signal that is applied to the second input 39 located on the pulse drive circuit 14C. This feedback signal, in turn, causes the signal from the first output 41 applied from the pulse drive circuit 14C to be applied to the second input 25 on the pulse generator 14. The frequency of the first output 27 from the pulse generator 14A is applied to the input 31 on the pulse width modulator 14B. This application controls both the voltage and the current that is applied to the input 73 of the LED load 16.

The current control circuit 14D is designed to automatically adjust both the voltage and the current applied to the LED load 16. To allow the current control circuit 14D maintain an optimum current flow, a varistor RV1 is connected across the circuit 14D and the current sample circuit 14E. The circuit 14D also produces a third output 47' that is connected to the second input 31' located on the pulse width modulator 14B.

The final two elements that comprise the LPCC 14 are the diode 14G and the external coil 14H. The diode 14G has an input that is connected to the anode 63 of the diode 14G and an output that is connected to the diode's cathode 65. The anode 63 is connected to the second input 59 on the MOSFET 14F. The diode 14G functions as a protective diode that prevents the MOSFET 14F from being damaged by a back Electro-Magnetic Force (EMF). The back EMF occurs when the magnetic field of the coil 14H collapses during the "OFF" time of the either of the voltage sources 12A and 12B.

The coil 14H includes an input 67 and an output 69. The input 67 is connected to the intersection of the second output 29 connected to the pulse generator 14A and the cathode 65 of the diode 14G. The coil 14H functions as a "filter choke" that is designed to smooth the square wave that is applied from the output 69 of the coil 14H to the input 73 of the LED load 16. The output 75 of the LED load 16 is connected to the intersection of the second input 59 of the MOSFET 14F and the anode 63 of the diode 14G. The LED load 16 is comprised of a plurality of LEDs 71 that preferably are connected in a series-parallel configuration.

Figure 3:
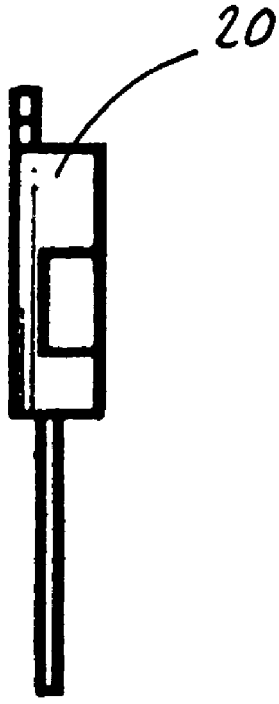
FIG. 3 is an elevational side view of the ASIC.

As shown in FIGS. 2 and 3, as a minimum the elements that comprise the LPCC 14 can be packaged in an application specific integrated circuit (ASIC) 20. The ASIC 20 reduces space and in most cases increases the reliability of the LPS 10.

While the invention has been described in detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

The invention claimed is:

1. An LED power supply (LPS) (10) comprising:

a) a power input circuit (12) comprising:

(1) a d-c voltage source (12A) having a first d-c voltage output (11) and a second output (13) that is connected to circuit ground (15), (2) an a-c voltage source (12B) having a first a-c voltage output (17) and a second output (13) that is connected to circuit ground (15), (3) a rectifier and filter circuit (12C) having an a-c voltage input (19) that is connected to the first a-c voltage output (17) applied from the a-c voltage source 12B, a filtered d-c voltage output 11', and a second output (13) that is connected to circuit ground (15), (4) an OR gate (12D) that is enabled upon the application of either the first d-c voltage output (11) from the d-c voltage source 12A or the filtered d-c voltage output 11' applied from the rectifier and filter circuit 12C, wherein the enabled OR gate (12D) produces a filtered d-c voltage (21), b) an LED power control circuit (LPCC) (14) comprising:

(1) a pulse generator (14A) that is applied a first d-c voltage input (23) that is connected to the filtered d-c voltage (21) from the OR gate (12D), a second input (25), a first output (27) and a second output (29), (2) a pulse width modulator (14B) having a first input (31) that is connected to the first output (27) applied from the pulse generator (14A), a second input (31'), a first output (33) that is connected to circuit ground (15), and a second output (35), (3) a pulse drive circuit (14C) having a first input (37) that is connected to the second output (35) applied from the pulse width modulator (14B), a second input (39), a first output (41) that is applied to the second input (25) connected to the pulse generator (14A), and a second output (43), (4) a current control circuit (14D) having an input (45), a first output (47) that is applied to the second input (39) located on the pulse drive circuit (14C), a second output (49) connected to circuit ground (15), and a third output (47') that is connected to the second input (31') located on the pulse width modulator (14B), (5) a current sample circuit (14E) having an input (51), and a first output (53) connected to circuit ground (15), (6) a metal oxide semiconductor field-effect transistor (MOSFET) (14F) having a first input (57) connected to the second output (43) applied from the pulse drive circuit (14C), a second input (59), and an output (61) applied to the input (51) connected to the current sample circuit (14E), (7) a diode (14G) having an anode (63) and a cathode (65), wherein the anode (63) is connected to the second input (59) located on the MOSFET (14F), (8) a coil (14H) having an input (67) and an output (69), wherein the input (67) is connected to the intersection of the second output (29) applied from the pulse drive circuit (14C) and the cathode (65) of the diode (14G), and (9) an LED load (16) that is comprised of a plurality of LEDs (71) that are connected in a series-parallel configuration, wherein said LED load (16) having an input (73) that is connected to the output (69) of the coil (14H), and an output (75) that is connected to the intersection of the second input (59) of the MOSFET (14F) and the anode (63) of the diode (14G).

2. The LPS as specified in claim 1 wherein the d-c voltage source ranges from 8 to 250 volts.

3. The LPS as specified in claim 1 wherein the a-c voltage source is provided from a utility power source comprising 120 volts a-c at a frequency that is established at the location where the LPS is to be used.

4. The LPS as specified in claim 3 wherein the a-c voltage source comprises 120 volts a-c at a frequency of 60 Hertz.

5. The LPS as specified in claim 3 wherein the voltage rectifier and filter circuit having means for converting the a-c voltage output to a filtered d-c voltage.

6. The LPS as specified in claim 1 wherein the pulse generator is comprised of an oscillator that produces a symmetrical square wave output that is utilized to power the LEDs and the pulse width modulator.

7. The LPS as specified in claim 6 wherein the pulse width modulator has means for varying the on time of the pulse width of the applied symmetrical square wave which, in turn, controls the output voltage and current applied to the LEDs, wherein the longer the on time of the pulse width, the higher the voltage and current that is applied to the LEDs.

8. The LPS as specified in claim 7 wherein the pulse drive circuit having means for sampling the symmetrical square wave and providing a feedback output that is applied to the pulse generator, wherein the pulse drive circuit comprises a self-adjusting "closed loop" circuit that maintains the voltage that is applied to the LEDs at a constant level, wherein the pulse drive circuit also produces a varying square wave that is applied to the MOSFET which functions as an ON and OFF switch, thus allowing current to flow through the LEDs to ground via the current sample circuit when the MOSFET is turned ON.

9. The LPS as specified in claim 8 wherein the current sample circuit having means for monitoring the current drawn by the LED load and producing an output signal that is applied to the current control circuit for further processing.

10. The LPS as specified in claim 9 wherein the current control circuit having means for automatically adjusting the voltage and the current that is applied to the LEDs.

11. The LPS as specified in claim 1 wherein the diode that is connected between the MOSFET and the coil functions as a protective diode that prevents the MOSFET from being damaged by a back EMF which occurs when the magnetic field of the coil collapses during the OFF time of the d-c or a-c power source.

12. The LPS as specified in claim 11 wherein said coil functions as a filter choke that smoothes the voltage applied to the LEDs to prevent the LEDs from flickering.

13. The LPS as specified in claim 1 wherein as a minimum the elements that comprise said LPCC can be packaged in an application specific integrated circuit (ASIC).

14. The LPS as specified in claim 1 further comprising a crystal (Y1) that is connected across said pulse width modulator, wherein said crystal (Y1) allows said modulator to maintain an optimum frequency.

15. The LPS as specified in claim 1 further comprising a varistor that is connected across said current control circuit and said current sample circuit, wherein said varistor is used to maintain an optimum current flow across the two said circuits.

* * * * *